United States Patent [19]

Frey

[11] 4,052,489

[45] Oct. 4, 1977

[54] CARBURETOR CIRCUIT FOR INTERNAL COMBUSTION ENGINES

[76] Inventor: Roberto Jose Frey, Rua Guapore, 450, Sao Paulo, S.P., Brazil

[21] Appl. No.: 675,807

[22] Filed: Apr. 12, 1976

[30] Foreign Application Priority Data

May 15, 1975 Brazil ..... 5500450

[51] Int. Cl.[2] ..... F02M 7/08

[52] U.S. Cl. ..... 261/34 A

[58] Field of Search ..... 261/34 A, 34 B

[56] References Cited

U.S. PATENT DOCUMENTS

| | | | |
|---|---|---|---|
| 1,763,361 | 6/1930 | Kirby | 261/34 A |
| 1,964,172 | 6/1934 | Prentiss | 261/34 B |
| 1,974,286 | 9/1934 | Monosmith et al. | 261/34 A |
| 2,133,207 | 10/1938 | Mennesson | 261/34 A |
| 3,017,167 | 1/1962 | Griffen | 261/34 A |
| 3,249,345 | 5/1966 | Gast | 261/39 D |
| 3,674,245 | 7/1972 | Massarotti | 261/34 A |

FOREIGN PATENT DOCUMENTS

| | | | |
|---|---|---|---|
| 401,698 | 11/1933 | United Kingdom | 261/34 A |

*Primary Examiner*—Tim R. Miles
*Attorney, Agent, or Firm*—Michael J. Striker

[57] ABSTRACT

The intake manifold of a carburetor of an internal combustion engine has between its air inlet end and its discharge end a throat portion and a butterfly valve adjacent the discharge end. First fuel injection means communicate with the interior of the manifold in the region of the throat portion for injection of fuel into the latter during normal operation of the engine, and second fuel injection means communicate with the interior of the manifold above and closely adjacent the butterfly valve for injecting additional fuel into the latter during acceleration of the engine.

5 Claims, 2 Drawing Figures

CARBURETOR CIRCUIT FOR INTERNAL COMBUSTION ENGINES

BACKGROUND OF THE INVENTION

As often experienced by motorists, the motor of the car operates in an irregular manner with jerks and spurts at critical times, such as on sudden passing, on exits in ascent, on acceleration after reduction and deceleration of speed, on entries into curves and on dangerous crossings, which evidently constitutes a serious problem. This problem is more pronounced with four cylinder motors, motors with low rotation and with only one carburetor. This problem is blamed on the distance between the single carburetor and the cylinders, which has forced many car owners to provide two carburetors to reduce this problem.

Sudden acceleration of the engine speed calls for an immediate increase in power output, and this in turn requires a momentary richer combustion engine, i.e., a mixture containing a higher proportion of gasoline. If the throttle valve or butterfly valve is suddenly opened when the engine is running at low speed, the suction developed by the low air velocity in the carburetor will not be sufficient by itself to draw enough gasoline from the choke tube to raise the engine speed. While it is well known in the art to provide at this moment an extra supply of gasoline through an injection pump which is connected to the accelerator pedal and synchronized with the butterfly valve, so that as the latter turns to the open position, while feeding of gasoline through the idling or low speed discharge ports is reduced, experience has shown that the flow of air through the carburetor, at the moment of the sudden opening of the butterfly valve, is still too small to properly furnish the additional supply of gasoline injected through the single injector nozzle, necessarily calibrated in accordance with the motor, to the outlet end of the carburetor so that the above-mentioned problem still occurs during sudden acceleration of the motor.

This persistent "hesitation" of the motor during sudden acceleration has induced the inventor to search for a better solution.

On the basis of extensive studies and research it was observed by the inventor that the irregular operation of the motor, that is the above-mentioned momentary hesitation at sudden acceleration, was due to the fact that, the additional gasoline injected did not immediately flow downwardly through the carburetor, but remained floating during the acceleration period on the top of the diffusor or neck portion of the carburetor, with a subsequent penetration of a large volume of gasoline with the descending air. As a result of this research the inventor came to the conclusion that the cause of the above-mentioned problem is that, due to the long distance between the usual injector nozzle and the butterfly valve, a gush of air separates, at the moment of acceleration, the stream of atomized fuel between the outlet end of the injector nozzle and the butterfly valve and also that the entry of air into the diffusor may be retarded at the instance of an injection.

SUMMARY OF THE INVENTION

It is an object of the present invention to overcome the above-pointed out problems occuring during sudden acceleration of internal combustion engines.

It is a further object of the present invention to overcome these problems with a construction of unobvious simplicity.

With these and other objects in view, which will become apparent as the description proceeds, the present invention relates to a carburetor circuit for an internal combustion engine, including a carburetor having an intake manifold having an air inlet end and an opposite discharge end and a throat portion between said ends, a butterfly valve in the intake manifold adjacent the discharge end, movable between open and closed position, fuel feed passages communicating with the interior of the manifold in the region of the butterfly valve for feeding fuel into the manifold during idling of the engine, first fuel injection means for injecting fuel in the region of the throat portion into the interior of the manifold during normal operation of the engine, and second fuel injection means for injecting part of the fuel passing therethrough into the interior of the manifold in the region between the throat portion and the butterfly valve, during acceleration of the engine.

The second injection means comprises a first tube having an outlet end in the region of the inlet end and a second tube, branching off from the first, and having an outlet end above and closely adjacent to the butterfly valve.

The butterfly valve is turnable from the closed to the open position in a predetermined direction so that one wing of the butterfly valve moves downwardly toward the discharge end, and the outlet end of the second tube is located above and closely adjacent to the aforementioned one wing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
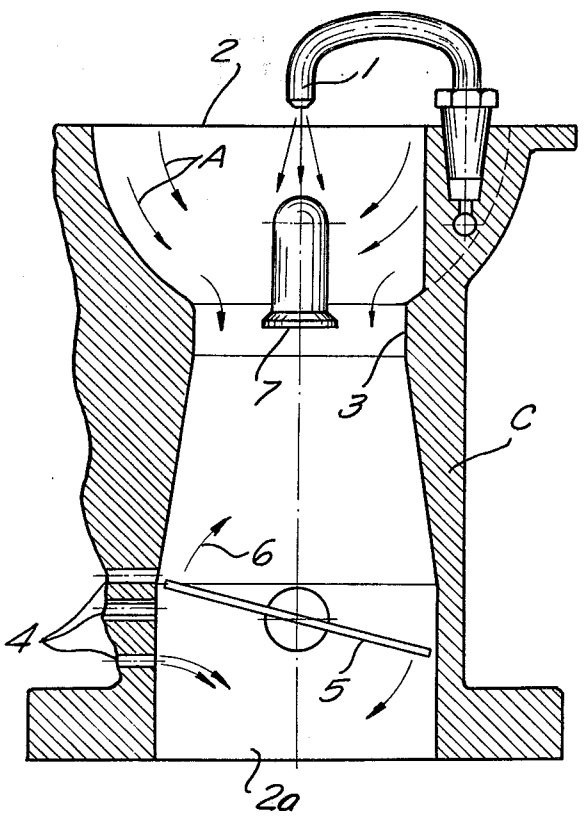
FIG. 1 (PRIOR ART)
FIG. 1 is a cross section through a carburetor according to the prior art.

FIG. 1 of the drawing illustrates part of a carburetor C according to the prior art having an intake manifold with an air inlet end 2 and an opposite discharge end **2*a*. The interior of the manifold is, as usual, in form of a Venturi having between the ends a throat portion or diffusor 3 of reduced diameter. As usual, a butterfly valve 5 is arranged above the discharge end 2*a* and the butterfly valve is connected in the usual manner to an accelerator pedal, not shown in the drawing, to be turned in the direction of the arrow 6 from a closed to an open position when the operator steps on the acceleration pedal. One or a plurality of idling speed or low speed discharge ports 4 are arranged in the region of the butterfly valve 6 to feed, in a known manner, fuel into the interior of the intake manifold of the carburetor during idling or slow speed from the fuel bowl of the carburetor, not shown in the drawing. First fuel injector means in form of a nozzle 7, having an outlet end in the region of the diffusor or throat portion 3, are provided for feeding, in a manner known per se, fuel into the interior of the manifold during normal operation of the combustion engine, in which fuel is sucked from the fuel bowl by the air stream, indicated by the arrow A, created when the butterfly valve is in the open position, at which passage of fuel through the discharge ports 4 is reduced. Second fuel injection means in form of a nozzle 1, arranged above the nozzle 7, are provided through which an additional stream or jet of fuel is injected at the moment of acceleration of the engine by means of an injection pump of known construction, not illustrated in the drawing, which is connected in the usual manner to the nozzle 1 and which is operated when the driver steps on the acceleration pedal, which also moves, in a well known manner, the butterfly valve 5** from the partly closed to the open position.

As mentioned above, during sudden opening of the butterfly valve, the onrushing air stream temporarily interrupts the jet of atomized fuel emanating from the nozzles 1 and 7 so that the fuel jets injected therethrough will not instantaneously reach the discharge end 2*a*.

Figure 2:
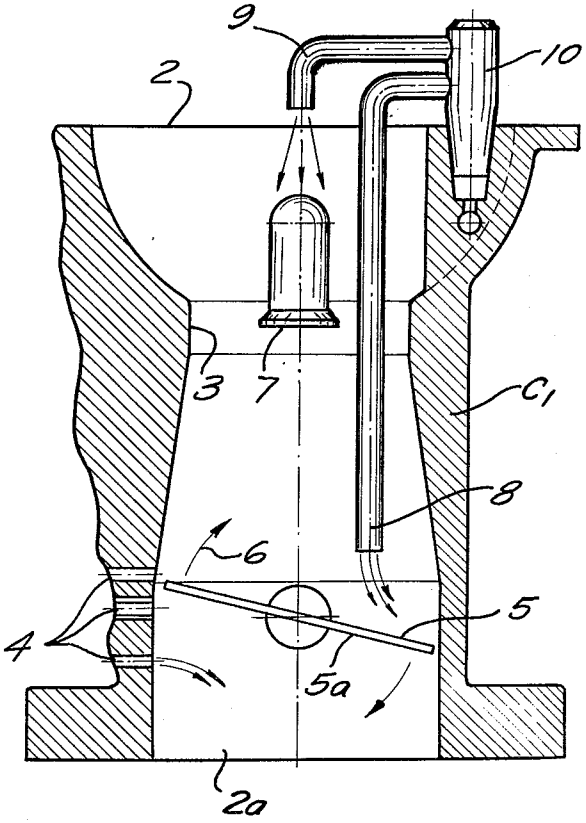
FIG. 2 is a cross section through a carburetor according to the present invention.

FIG. 2 illustrates the carburetor $C_1$ according to the present invention. In this construction there are provided, instead of the single additional nozzle 1 shown in FIG. 1, two small diameter tubes or nozzles 8 and 9 which are connected to the aforementioned commonly used injection pump. The tube or nozzle 9 has an outlet end above the nozzle 7 in the same manner as shown in FIG. 1, but the tube or nozzle 8, branching off from the common tube 10, which is connected to the non-illustrated injection pump, extends downwardly past the injection nozzle 7 and has an outlet end adjacent to the butterfly valve 5. Actually, the outlet end of the small diameter tube or nozzle 8 is located closely adjacent above the wing 5*a* of the butterfly valve which moves, during movement of the latter from the closed to the open position, away from the outlet end of the tube 8. In this way the distance between the butterfly valve and the outlet end of the small diameter tube 8, through which additional fuel is injected at the moment of acceleration, is reduced so that additional fuel will be injected closely adjacent to the butterfly valve 5 at the moment of acceleration, in which feeding of fuel to the discharge ports 4 is reduced as the butterfly valve 5 moves to the open position. As the suction produced by opening of the butterfly valve reaches the upper end of the carburetor feeding of fuel through the nozzle 9 will be increased and proportionally passage of fuel through the nozzle 8 decreased, and subsequently this situation will cause flow of fuel from the fuel bowl or tank of the carburetor through the nozzle 7, which will mix with and be atomized by the air stream to provide the proper air-fuel mixture during normal operation of the engine.

It should be noted that the carburetor shown in FIG. 1 can be easily modified to the carburetor according to the present invention by replacing the nozzle 1 by the double nozzle as shown in FIG. 2.

It will be understood that each of the elements described above, or two or more together, may also find a useful application in other types of carburetor circuits for internal combustion engines differing from the types described above.

While the invention has been illustrated and described as embodied in a carburetor circuit for an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a carburetor circuit for an internal combustion engine, a combination comprising a carburetor having wall means defining an intake manifold having an air inlet end, an opposite discharge end, and a throat portion between said ends, said wall means being formed in the region of said inlet end with an outlet through which fuel is fed during acceleration of said engine; a butterfly valve in said intake manifold adjacent said discharge end movable between an open and a closed position; fuel feed passages communicating with the interior of said manifold in the region of said butterfly valve for feeding fuel into the manifold during idling of the engine; first fuel injection means for injecting fuel into the region of the throat portion into the interior of the manifold during the normal operation of said engine; and second fuel injection means for feeding fuel into said manifold during acceleration of the engine and comprising a tube portion tightly inserted into said outlet, a first small diameter tube communicating with said tube portion and having an outlet end in the region of said inlet end of said manifold and a second small diameter tube communicating with said tube portion and having an outlet end closely adjacent said butterfly valve, said second small diameter tube extending through the interior of said manifold.

2. A combination as defined in claim 1, wherein said butterfly valve is turnable from said closed to said open position in a predetermined direction so that one wing of the butterfly valve moves downwardly toward the discharge end, and wherein said outlet end of said second tube is located above and closely adjacent said one wing.

3. A combination as defined in claim 1, wherein said manifold has a longitudinal axis, and wherein said first injection means has an outlet end located in the region of the throat portion and at said longitudinal axis.

4. A combination as defined in claim 3, wherein said outlet end of said first tube is located above that of said first fuel injection means and adjacent the latter.

5. A combination as defined in claim 4, wherein said second small diameter tube extends with a major portion thereof substantially parallel to the longitudinal axis of said manifold.

* * * * *